US009063495B2

(12) United States Patent
Kim et al.

(10) Patent No.: US 9,063,495 B2
(45) Date of Patent: Jun. 23, 2015

(54) FUSING UNIT AND IMAGE FORMING APPARATUS INCLUDING THE SAME

(71) Applicants: SAMSUNG ELECTRONICS CO., LTD., Suwon (KR); SANG-A FRONTEC, Incheon (KR)

(72) Inventors: Jun O Kim, Yongin (KR); Dae Hwan Kim, Seoul (KR); Ji Hong Jung, Incheon (KR); Seung Oh Ko, Incheon (KR); Young Dae Ko, Suwon (KR); Jin Han Kim, Suwon (KR); Jong Man Choi, Incheon (KR)

(73) Assignees: SAMSUNG ELECTRONICS CO., LTD., Suwon-Si (KR); SANG-A FRONTEC, Incheon (KR)

( * ) Notice: Subject to any disclaimer, the term of this patent is extended or adjusted under 35 U.S.C. 154(b) by 0 days.

(21) Appl. No.: 13/953,259

(22) Filed: Jul. 29, 2013

(65) Prior Publication Data

US 2014/0037347 A1 Feb. 6, 2014

(30) Foreign Application Priority Data

Aug. 6, 2012 (KR) ..... 10-2012-0085674

(51) Int. Cl.
*G03G 15/20* (2006.01)

(52) U.S. Cl.
CPC ..... *G03G 15/2085* (2013.01); *G03G 15/2042* (2013.01); *G03G 15/2028* (2013.01)

(58) Field of Classification Search
CPC ..... G03G 15/2042; G03G 15/2082
USPC ..... 399/333
See application file for complete search history.

(56) References Cited

U.S. PATENT DOCUMENTS

| | | | | |
|---|---|---|---|---|
| 5,826,152 | A * | 10/1998 | Suzuki et al. | 399/330 |
| 8,165,485 | B2 * | 4/2012 | Asakura et al. | 399/69 |
| 8,265,507 | B2 * | 9/2012 | Saito et al. | 399/69 |
| 2004/0190955 | A1 * | 9/2004 | Morihara | 399/328 |
| 2011/0091251 | A1 * | 4/2011 | Kim et al. | 399/333 |
| 2011/0229227 | A1 * | 9/2011 | Yoshikawa et al. | 399/329 |
| 2011/0286775 | A1 * | 11/2011 | Ishihara et al. | 399/329 |
| 2011/0299903 | A1 * | 12/2011 | Yamamoto et al. | 399/329 |

FOREIGN PATENT DOCUMENTS

JP 2007272223 A * 10/2007

OTHER PUBLICATIONS

Meincke et al ("Mechanical properties and electrical conductivity of carbon-nanotube filled polyamide-6 and its blends with acrylonitrile/butadiene/styrene", Polymer 45, No. 3 (2004): 739-748).*

* cited by examiner

*Primary Examiner* — Clayton E Laballe
*Assistant Examiner* — Leon W Rhodes, Jr.
(74) *Attorney, Agent, or Firm* — Staas & Halsey LLP

(57) ABSTRACT

A fusing unit and an image forming apparatus to form an image on a recording medium including a fusing unit are provided. The image forming apparatus includes a heating member having a surface divided into a plurality of heating regions and heating the recording medium, and a pressurizing member to apply pressure to the recording medium, the fusing unit fusing the image to the recording medium by applying heat and pressure to the recording medium, a driving unit to supply rotational force to the pressurizing member, and a power supply to supply power to the heating member and the driving unit, wherein the heating regions have different heating values per unit area. The image forming apparatus prevents overheating of a paper-contact heating region without idling the fusing unit in order to radiate heat accumulated in the paper-contact heating region.

36 Claims, 10 Drawing Sheets

FUSING UNIT AND IMAGE FORMING APPARATUS INCLUDING THE SAME

CROSS-REFERENCE TO RELATED APPLICATIONS

This application is related to, and claims priority to Korean Patent Application No. 10-2012-085674, filed on Aug. 6, 2012 in the Korean Intellectual Property Office, the disclosure of which is incorporated herein by reference.

BACKGROUND

1. Field

Embodiments of the present invention relate to a fusing unit including a paper-contact heating region through which a recording medium passes and a paper non-contact heating region, through which the recording medium does not pass, having different heating values per unit area, and an image forming apparatus using the same.

2. Description of the Related Art

An electrophotographic image forming apparatus prints an image on a recording medium by irradiating light to a charged photosensitive material to form an electrostatic latent image, developing the electrostatic latent image using a toner, and transferring and fusing (fixing) the same on the recording medium. The electrophotographic image forming apparatus includes a fusing unit on a printing passage so as to fuse the transferred toner.

The fusing unit heats and pressurizes the toner-transferred recording medium so as to fuse (fix) the transferred toner on the recording medium, instead of separating the transferred toner from the recording medium. The fusing unit includes a heating roller to heat the transferred recording medium and a pressurizing member to apply pressure to the toner-transferred recording medium.

The heating roller and the pressurizing member may have a greater width than that of the recording medium, since the recording medium may not always be supplied to the fusing unit while being accurately arranged at an intended position.

The heating roller includes a paper-contact heating region through which the recording medium passes, and a paper non-contact heating region through which the recording medium does not pass. Heat generated to heat the recording medium is transferred to the paper-contact heating region of the heating roller, while generated heat is accumulated in the heating roller in the paper non-contact heating region of the heating roller, instead of being transferred to the recording medium.

As a result, a temperature of the paper non-contact heating region, in which heat is accumulated, gradually increases. When accumulated heat is not dissipated, the heating roller may overheat and cause a fire.

In an attempt to address these problems, in conventional methods, heat accumulated in the paper non-contact heating region may be emitted by idling the heating roller, while the heating roller of the fusing unit does not generate heat.

However, this cyclic idling of the heating roller requires a consumption of power to idle the heating roller and causes an increase in printing time.

SUMMARY

It is an aspect to provide a fusing unit to prevent a paper non-contact heating region of the fusing unit from being overheated, without idling the fusing unit, and an image forming apparatus including the same.

Additional aspects of the invention are set forth in part in the description which follows and, in part, will be obvious from the description, or may be learned by practice of the invention.

In accordance with an aspect of the present invention, a fusing unit to fuse an image to a recording medium by applying heat and pressure to the recording medium includes a heating member to heat the recording medium, and a pressurizing member to apply pressure to the recording medium, wherein the heating member is divided into a paper-contact heating region contacting the recording medium and a paper non-contact heating region not contacting the recording medium, and a heating value per unit area of the paper-contact heating region is different from a heating value per unit area of the paper non-contact heating region.

The heating value per unit area of the paper-contact heating region may be greater than the heating value per unit area of the paper non-contact heating region.

A ratio of the heating value per unit area of the paper-contact heating region and the heating value per unit area of the paper non-contact heating region may be 1:0.1 to 1:0.7.

The heating member may include a heating layer to generate heat to enable heating of the recording medium, wherein the heating layer includes a paper-contact heating region heating layer provided in the paper-contact heating region and a paper non-contact heating region heating layer provided in the paper non-contact heating region, and a heating value per unit area of the paper-contact heating region heating layer is different from a heating value per unit area of the paper non-contact heating region heating layer.

The heating layer may include polyimide containing carbon nanotubes (CNTs), and the paper-contact heating region heating layer and the paper non-contact heating region heating layer may have different carbon nanotube contents.

The heating member may include an insulating layer provided on an outer surface of the heating layer to insulate the heating layer from the outside and a release layer to form the surface of the heating member and prevent foreign matter from being adhered to the surface of the heating member.

The heating member may include a core provided in the center of the heating member to support the heating member, and an elastic layer to supply elasticity to the heating member so as to form a fusing nip between the pressurizing member and the heating member.

The pressurizing member may include a core provided in the center of the pressurizing member to support the pressurizing member, an elastic layer to elastic-restore the pressurizing member to an original shape when a surface of the pressurizing member is crushed, and a release layer to prevent foreign matter from being adhered to the surface of the pressurizing member.

The heating member may include an electrode to supply power to the heating member at both ends thereof.

The electrode may be provided outside of the elastic layer of the heating member. In this case, a portion of the electrode may contact the heating layer and the remaining portion thereof may be exposed to the outside and the electrode may be formed on an outer surface of the elastic layer of the heating member by plating or deposition.

The electrode may be provided outside of the heating layer, the heating member may include an adhesive sheet to fix the electrode on the outer surface of the heating layer, and a metal paste to electrically connect the electrode to the heating layer.

The electrode may be provided on an inner surface of the heating layer. The elastic layer of the heating member may include a groove to expose an inner surface of the electrode to the outside.

The fusing unit may include a support member to support the heating member, wherein the heating member has a cylindrical hollow shape and contacts an outer surface of the support member. The support member may include a support plate to maintain a shape of the heating member, and a fusing nip plate to enable formation of a fusing nip between the heating member and the pressurizing member. The heating member may rotate along the outer surface of the support member, when it receives rotational force from the pressurizing member.

In accordance with an aspect of the present invention, an image forming apparatus to form an image on a recording medium, including a fusing unit including a heating member to heat the recording medium and a pressurizing member to apply pressure to the recording medium, the fusing unit fusing the image to the recording medium by applying heat and pressure to the recording medium, a driving unit to supply rotational force to the pressurizing member, and a power supply to supply power to the heating member and the driving unit, wherein the heating member is divided into a paper-contact heating region contacting the recording medium and a paper non-contact heating region not contacting the recording medium, and a heating value per unit area of the paper-contact heating region is different from a heating value per unit area of the paper non-contact heating region.

The heating value per unit area of the paper-contact heating region may be greater than the heating value per unit area of the paper non-contact heating region and a ratio of the heating value per unit area of the paper-contact heating region and the heating value per unit area of the paper non-contact heating region may be 1:0.1 to 1:0.7.

The heating member may include a heating layer to generate heat to enable heating of the recording medium, wherein the heating layer includes a paper-contact heating region heating layer provided in the paper-contact heating region and a paper non-contact heating region heating layer provided in the paper non-contact heating region, and a heating value per unit area of the paper-contact heating region heating layer is different from a heating value per unit area of the paper non-contact heating region heating layer.

The heating layer may include polyimide containing carbon nanotubes (CNTs) and the paper-contact heating region heating layer and the paper non-contact heating region heating layer may have different carbon nanotube contents.

The heating member may include an insulating layer provided on an outer surface of the heating layer to insulate the heating layer from the outside and the heating member may further include a release layer to form the surface of the heating member and prevent foreign matter from being adhered to the surface of the heating member.

The heating member may include a core provided in the center of the heating member to support the heating member, and an elastic layer to supply elasticity to the heating member so as to form a fusing nip between the pressurizing member and the heating member.

The pressurizing member may include a core provided in the center of the pressurizing member to support the pressurizing member, an elastic layer to supply elastic-restore the pressurizing member to an original shape when a surface of the pressurizing member is crushed, and a release layer to prevent foreign matter from being adhered to the surface of the pressurizing member.

The heating member may include an electrode to supply power to the heating member at both ends thereof.

The electrode may be provided outside of the elastic layer of the heating member, a portion of the electrode contacts the heating layer and the remaining portion thereof may be exposed to the outside, and the electrode may be formed on an outer surface of the elastic layer of the heating member by plating or deposition.

The electrode may be provided outside of the heating layer, the heating member may further include an adhesive sheet to fix the electrode on the outer surface of the heating layer, and a metal paste to electrically connect the electrode to the heating layer.

The electrode may be provided on an inner surface of the heating layer and the elastic layer of the heating member may include a groove to expose an inner surface of the electrode to the outside.

The image forming apparatus may include a support member to support the heating member, wherein the heating member has a cylindrical hollow shape and contacts an outer surface of the support member. In addition, the support member may include a support plate to maintain a shape of the heating member, and a fusing nip plate to enable formation of a fusing nip between the heating member and the pressurizing member. The heating member may rotate along the outer surface of the support member, when it receives rotational force from the pressurizing member.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
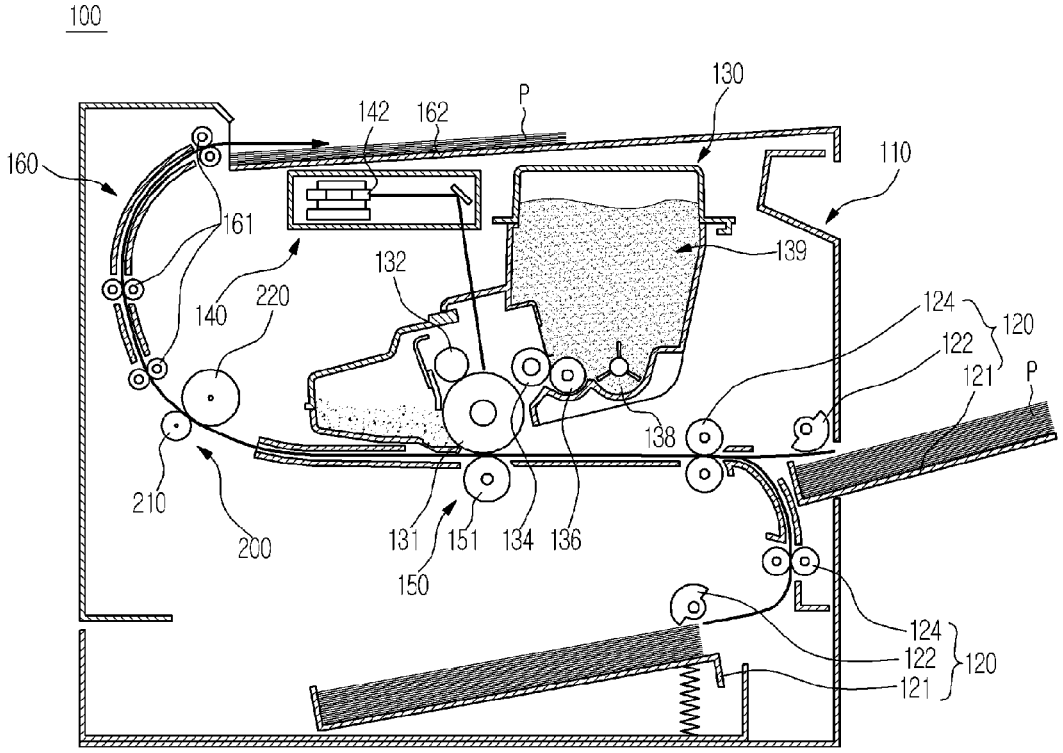
FIG. 1 illustrates an image forming apparatus according to an embodiment of the present invention.

Reference will now be made in detail to the embodiments of the present invention, examples of which are illustrated in the accompanying drawings, wherein like reference numerals refer to like elements throughout.

FIG. 1 illustrates an exemplary an image forming apparatus 100 according to an embodiment of the present invention.

Referring to FIG. 1, the image forming apparatus 100 according to an embodiment of the present invention includes a body 110 to form an outer appearance of the image forming apparatus 100, a paper feed unit 120 to store and supply a recording medium, an exposure unit 140 to form an electrostatic latent image on a photosensitive material 131, a development unit 130 to develop a toner image T on the electrostatic latent image formed by the exposure unit 140, a transfer unit 150 to transfer the toner image T formed by the development unit 130 to a recording medium P, a fusing unit 200 to fuse the toner image T transferred to the recording medium P and a paper discharge unit 160.

The paper feed unit 120 includes a pick-up plate 121 on which a plurality of recording media P are stacked, a pick-up roller 122 to pick up the recording media P stored in the paper feed unit 120 one by one, and a transfer roller 124 to guide the recording medium P picked-up by the pick-up roller 122 toward the development unit 130 and the transfer unit 150.

The exposure unit 140 irradiates light corresponding to image information to the photosensitive material 131 to form an electrostatic latent image on an outer circumferential surface of the photosensitive material 131. The exposure unit 140 includes a light source (not shown) to irradiate light corresponding to image information and a light deflector 242 to deflect the light irradiated from the light source (not shown).

The development unit 130 may be detachably mounted in the body of the image forming apparatus 100 and includes the photosensitive material 131, a charging roller 132, a development roller 134, a feed roller 136 and a stirrer 138.

The photosensitive material 131 may have a cylindrical drum shape, and be disposed such that a part of the outer circumferential surface thereof is exposed and rotates in a predetermined direction. A photoconductive material may be applied to the outer circumferential surface of the cylindrical drum.

The photosensitive material 131 may be charged with a predetermined electric charge by the charging roller 132. An electrostatic latent image corresponding to an image to be printed may be formed on the outer circumferential surface thereof by light irradiated by the exposure unit 140.

The development roller 134 includes a solid powder form of toner attached to the outer circumferential surface thereof and supplies the attached toner to the electrostatic latent image formed in the photosensitive material 131 and thereby develops the electrostatic latent image into a toner image T. A bias may be applied to the development roller 134 so as to supply the toner to the photosensitive material 131 and perform development.

The outer circumferential surface of the development roller 134 may contact the outer circumferential surface of the photosensitive material 131 to form a development nip, or the outer circumferential surface of the development roller 134 may be spaced from the outer circumferential surface of the photosensitive material 131 to form a development gap. The development nip or the development gap may be uniformly formed in an axis direction of the development roller 134 and the photosensitive material 131.

The feed roller 136 supplies a toner to the outer circumferential surface of the development roller 134 so as to adhere the toner thereto. The stirrer 138 transfers the toner toward the feed roller 136 while stirring the toner so as to prevent the toner in the toner storage unit 139 from hardening.

The transfer unit 150 includes a transfer roller 151, and the transfer roller 151 contacts the outer circumferential surface of the photosensitive material 131 and a bias which is the opposite to the polarity of the toner image T is applied to the transfer roller 151 such that the toner image T developed on the photosensitive material 131 is transferred to the recording medium P. Electrostatic attraction and mechanical contact pressure applied between the photosensitive material 131 and the transfer roller 151 enable the toner image T to transfer to the recording medium P.

The fusing unit 200 applies heat and pressure to the toner image T transferred to the recording medium P and thereby fuses (fixes) the toner image T on the recording medium P.

The paper discharge unit 160 includes a paper discharge roller 161 and the paper discharge roller 161 discharges the recording medium P fused to the toner image T by the fusing unit 200 to the outside of the image forming apparatus 100. The recording medium P discharged by the paper discharge roller 161 is loaded on a paper discharge stage 162.

Figure 2:
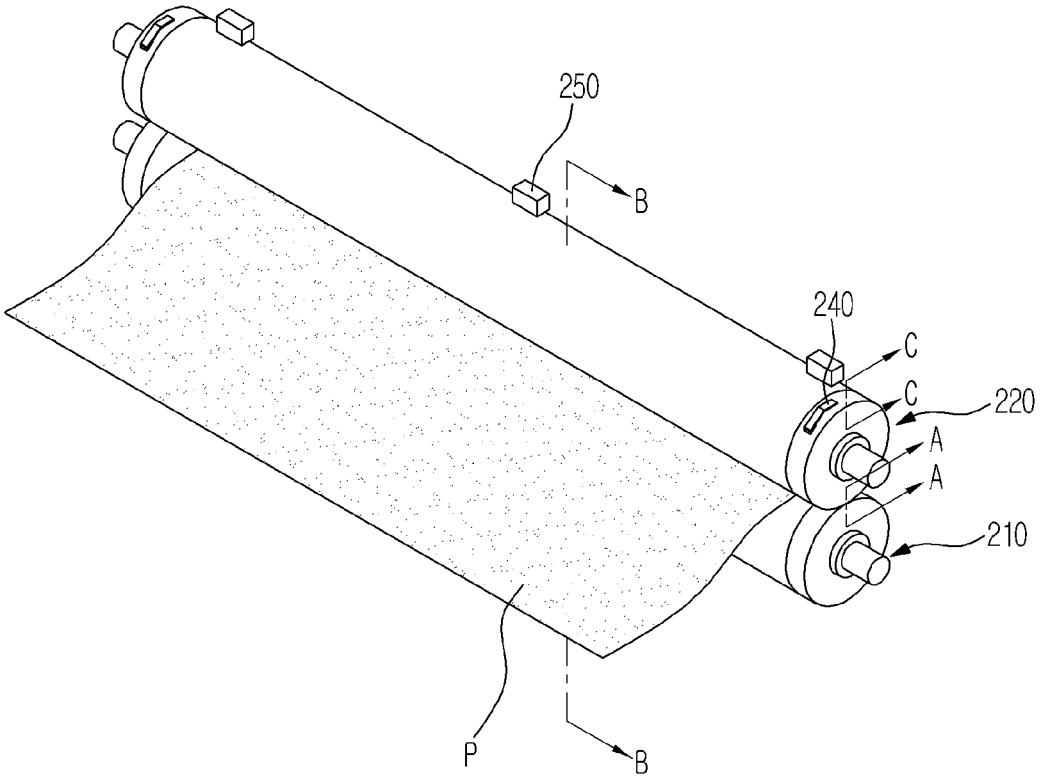
FIG. 2 illustrates a fusing unit according to an embodiment of the present invention.
Figure 3:
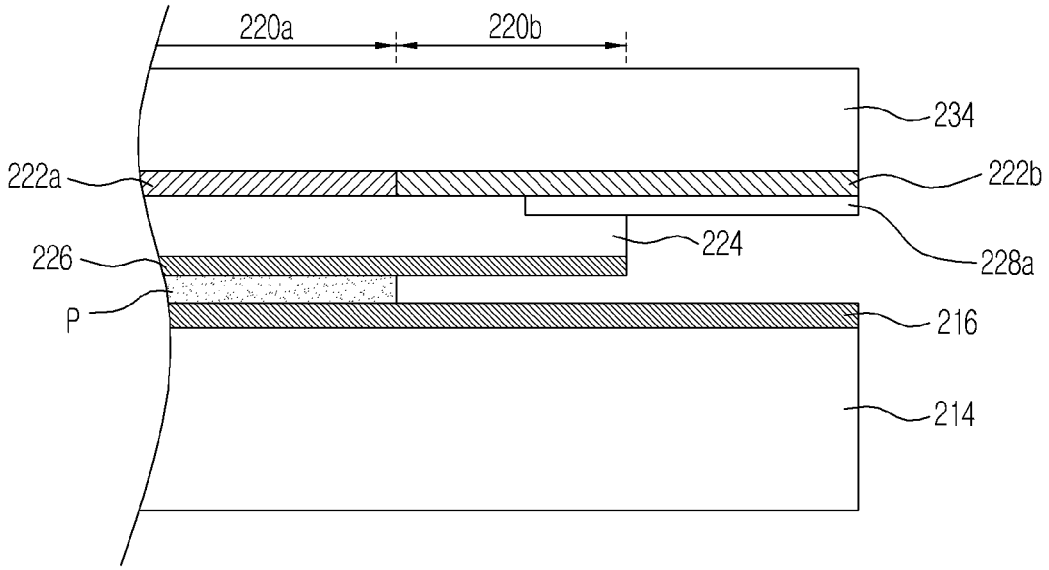
FIG. 3 is a sectional view along the line A-A' of FIG. 2.
Figure 4:
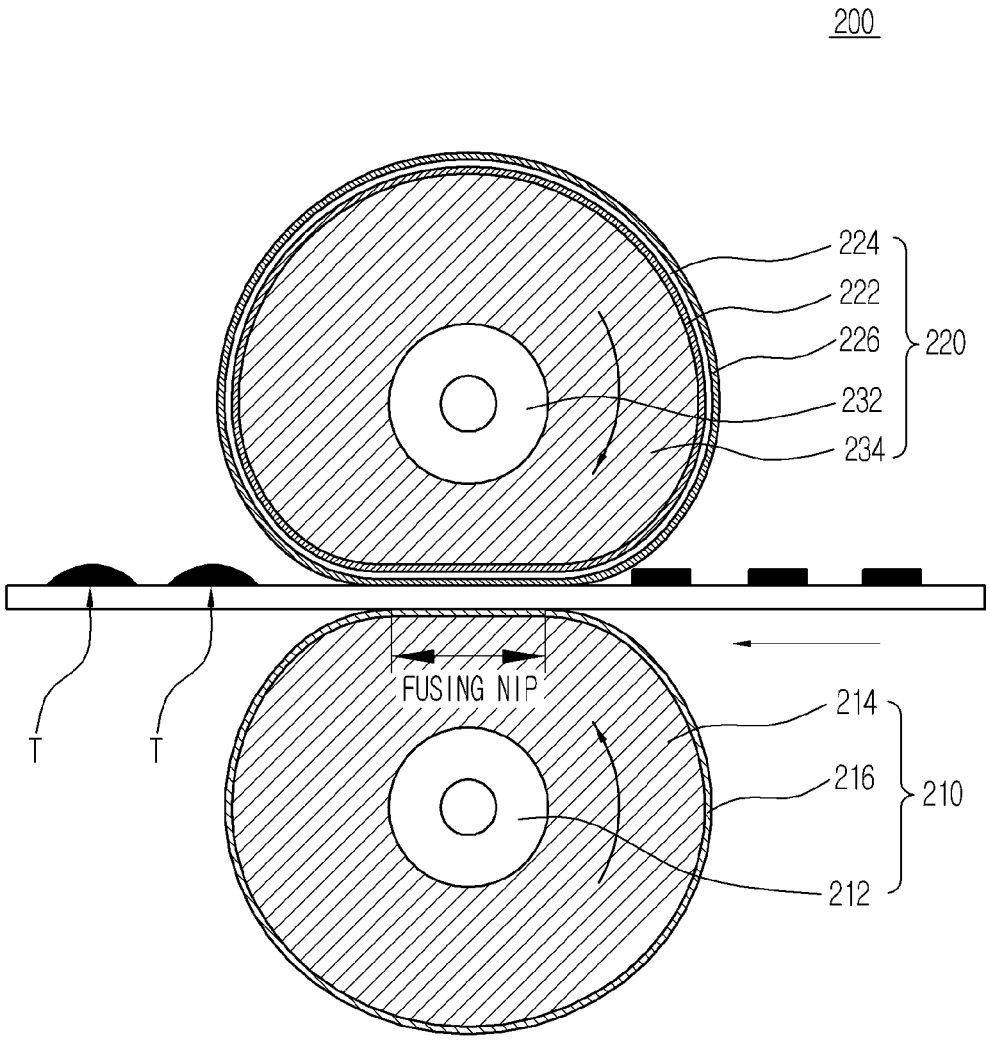
FIG. 4 is a sectional view along the line B-B' of FIG. 2.

FIG. 2 illustrates a fusing unit 200 according to an embodiment of the present invention. FIG. 3 is a sectional view along the line A-A' of FIG. 2. FIG. 4 is a sectional view along the line B-B' of FIG. 2.

A fusing unit 200 is described in more detail with reference to FIGS. 2, 3 and 4.

The fusing unit 200 includes a pressurizing member 210 having a roller shape, a heating member 220 having a roller shape and a temperature sensor 250 to sense a temperature of the heating member 220.

The pressurizing member 210 includes a core 212 to support the pressurizing member 210, an elastic layer 214 to elastic-restore the pressurizing member 210 to an original shape when the surface of the pressurizing member 210 is crushed, and a release layer 216 to prevent foreign matter such as toner from being adhered to the surface of the pressurizing member 210.

The core 212 of the pressurizing member 210 may be made of a metal material and may have a cylindrical shape and support the pressurizing member 210 in the pressurizing member 210. An elastic material (not shown) such as spring may be provided at both ends of the pressurizing member 210 to push the pressurizing member 210 toward the heating member 220. The core 212 may prevent the pressurizing member 210 from being deformed by a force supplied from the elastic material (not shown).

The core 212 of the pressurizing member 210 may function as a rotation axis, when the pressurizing member 210 rotates based on rotational force received from a driving unit. A driving motor (not shown) included in the driving unit supplies rotational force to the pressurizing member 210 through a power transfer apparatus such as a gear or a belt and the pressurizing member 210 rotates, based on the core 212.

The elastic layer 214 of the pressurizing member 210 may be provided outside of the core 212 and applies an elasticity to restore the pressurizing member 210 to an original shape, when an exterior pressure is applied to the pressurizing member 210 and the pressurizing member 210 is thus deformed. The elasticity supplied by the elastic layer 214 enables a fusing nip having a predetermined width to be formed between the pressurizing member 210 and the heating member 220, when the pressurizing member 210 applies pressure to the heating member 220.

The release layer 216 of the pressurizing member 210 may be provided outside the elastic layer 214 to prevent foreign matter, for example, toner floating in the image forming apparatus 100, from being adhered to the pressurizing member 210. When the toner floating in the image forming apparatus 100 is adhered to the pressurizing member 210, the toner may be transferred and fused to the recording medium P by pressure generated between the pressurizing member 210 and the heating member 220. The fused toner may cause formation of stains in the recording medium P and deterioration in print quality of the image forming apparatus 100. The pressurizing member 210 may inhibit this phenomenon of the release layer 216.

The pressurizing member 210 applies pressure to the heating member 220 to form a fusing nip. The pressurizing member 210 applies pressure to the recording medium P in the direction of the heating member 220 when the recording medium P passes through the fusing nip formed between the pressurizing member 210 and the heating member 220.

The pressurizing member 210 receives rotational force from the driving unit and rotates, based on a frictional force between the surface of the pressurizing member 210 and the surface of the heating member 220, when the pressurizing member 210 rotates. The pressurizing member 210 and the heating member 220 rotate in opposite directions since they rotate while they contact each other and are engaged with each other. As illustrated in FIG. 4, the heating member 220 rotates clockwise, when the pressurizing member 210 rotates counterclockwise.

The heating member 220 may have a cylindrical shape and the heating member 220 heats the recording medium P to melt the toner image T transferred to the recording medium P.

The heating member 220 may be divided into a paper-contact heating region 220*a* contacting the recording medium P and a paper non-contact heating region 220*b* not contacting the recording medium P. The fusing unit 200 may be designed such that the heating member 210 has a larger width than a width of the recording medium P, in order to heat the entire surface of the recording medium P. For this reason, for example, an edge of the heating member 220 does not contact the recording medium P. For example, regarding standards of the recording medium P, A4 paper has a width of 210 mm and a length of 297 mm, and letter paper has a width of 215.9 mm (8.5 inch) and a length 279.4 mm (11 inch). Although an image forming apparatus 100 may use A4 paper, the width of the heating member 220 may be equal to, or larger than, 215.9 mm so that the image forming apparatus 100 may normally operate, even when letter paper is used as the recording medium P. Accordingly, when A4 paper is used, the width of the heating member 210 may be about 6 mm larger than the width of the recording medium P, and the edge of the heating member 220 does not contact the recording medium P during fusing of the toner image T on the recording medium P.

The paper non-contact heating region 220*b* not contacting the recording medium P may be overheated since it does not transfer heat energy to the recording medium P. Accordingly, the paper-contact heating region 220*a* and the paper non-contact heating region 220*b* of the heating member 220 may have different heating values. The heating member 220 may be controlled such that a heating value per unit area of the paper non-contact heating region 220*b* is lower than that of the paper-contact heating region 220*a*. The inventors have found that from experimentation, in a case in which the recording medium P continuously passes through the fusing unit 200, the paper non-contact heating region 220*b* is not overheated, when a ratio of the heating value per unit area of the paper-contact heating region 220*a* and the heating value per unit area of the paper non-contact heating region 220*b* is 1:0.1 to 1:0.7, for example.

The heating member 220 includes a core 232 to support the heating member 220, an elastic layer 234 to supply elasticity to the heating member 220, a heating layer 222 to generate Joule heat by electrical resistance, an insulating layer 224 to insulate the heating layer 222 from the outside, and a release layer 226 to prevent foreign matter from being adhered to the surface of the heating member 220. An electrode 228*a* providing a passage of power supplied to the heating layer 222 may be provided on both ends of the heating member 220.

The core 232 of the heating member 220 has a cylindrical shape and may be provided in the center of the heating member 220 and supports the heating member 220 to prevent deformation of the heating member 220 when the pressurizing member 210 applies pressure to the heating member 220. The core 232 of the heating member 220 may function as a rotation axis, when the heating member 220 rotates while being engaged in the pressurizing member 210.

The elastic layer 234 of the heating member 220 may be provided outside of the core 232 to provide elasticity, enabling the heating member 220 to be restored to an original shape, when the heating member 220 receives exterior pressure and is then deformed. A fusing nip may be formed between the pressurizing member 210 and the heating member 220 due to the elasticity provided by the elastic layer 234.

The elastic layer 234 may be a silicone sponge, that is, a foam silicone rubber. A primer to stably adhere the core 232 to the elastic layer 234 may be applied to the outer circumferential surface of the core 232 of the heating member 220 and a liquid silicone rubber containing a pyrolytic foaming agent is then applied thereto. An elastic layer 234 containing fine bubbles formed by the pyrolytic foaming agent in the silicone rubber is formed through heating and curing processes.

The heating layer 222 may be provided outside the elastic layer 234 and generates Joule heat as a conductor having electrical resistance to heat the recording medium P. When power is supplied to the heating layer 222 through the electrode, Joule heat is generated by the heating layer 222, and a temperature of the heating member 220 is increased to 150° C. to 200° C. which is a temperature at which the toner image T is fused to the recording medium P.

The heating member 220 may be divided into the paper-contact heating region 220*a* and the paper non-contact heating region 220*b*, and the heating layer 222 is provided with a paper-contact heating region heating layer 222*a* corresponding to the paper-contact heating region 220*a* and a paper non-contact heating region heating layer 222*b* corresponding to the paper non-contact heating region 220*b* (see, for example, FIG. 3). The paper-contact heating region heating layer 222*a* and the paper non-contact heating region heating layer 222*b* may be formed of different materials having different heating values, enabling a heating value of the paper-contact heating region 220*a* to be different from a heating value of the paper non-contact heating region 220*b*. A material for the paper non-contact heating region heating layer 222*b* may be chosen so as to have a lower heating value per unit area than that of a material for the paper-contact heating region heating layer 222*a*. The values are chosen to aim at reducing the heating value of the paper non-contact heating region 220*b* and thereby preventing the paper non-contact heating region 220*b* from being overheated, since the paper-contact heating region 220*a* of the heating member 220 contacts the recording medium P, transfers heat energy to the recording medium P and thereby maintains a predetermined temperature, whereas the paper non-contact heating region 220*b* does not contact the recording medium P and may be overheated due to heat energy accumulated in the paper non-contact heating region 220*b*.

An exemplary material for the paper non-contact heating region heating layer 222*b* and an exemplary material for the paper-contact heating region heating layer 222*a* are described.

In accordance with Joule's Law, power consumed by a resistor is proportional to a heating value per unit hour generated by the resistor and is represented by the following Equation 1

$$P_R = I_R V_R = I_R^2 R \qquad \text{[Equation1]}$$

wherein $P_R$ represents power consumed by a resistor, $I_R$ represents current flowing in the resistor, $V_R$ represents a potential difference between both terminals of the resistor and R represents a resistance of the resistor.

In accordance with Equation 1, the power consumed by the resistor is proportional to electrical resistance of the resistor. That is, the heating value per unit hour generated in the resistor is proportional to the electrical resistance of the resistor.

The heating layer 222 is a resistor which generates Joule heat and thereby heats the recording medium P, and makes electrical resistance of the paper-contact heating region heating layer 222*a* different from that of the paper non-contact heating region heating layer 222*b* to make a heating value per unit area of the paper-contact heating region heating layer 222*a* different from that of the paper non-contact heating region 220*b*. The paper non-contact heating region heating layer 222*b* may be formed of a material having a lower electrical resistance than that of the paper-contact heating region heating layer 222*a* to make the heating value per unit area of the paper non-contact heating region heating layer 222*b* lower than that of the paper-contact heating region heating layer 222*a*.

The electrical resistance of the resistor is defined by the following Equation 2

$$R = \rho \frac{l}{A} \quad \text{[Equation 2]}$$

wherein R represents electrical resistance, ρ represents specific resistance of a material constituting the resistor, l represents a length of the resistor and A represents a cross-sectional area of the resistor.

In accordance with Equation 2, the electrical resistance of the resistor is proportional to specific resistance ρ that is an inherent property of the resistor. Accordingly, the heating value per unit area of the paper-contact heating region heating layer 222*a* and the heating value per unit area of the paper non-contact heating region heating layer 222*b* are proportional to specific resistances of materials for the heating layers 222*a* and 222*b*, respectively.

That is, the heating values per unit area of the paper-contact heating region heating layer 222*a* and the paper non-contact heating region heating layer 222*b* are made different by using materials having different specific resistances for the paper-contact heating region heating layer 222*a* and the paper non-contact heating region heating layer 222*b*. When the specific resistance of the paper non-contact heating region heating layer 222*b* is lower than the specific resistance of the paper-contact heating region heating layer 222*a*, the heating value per unit area of the paper non-contact heating region heating layer 222*b* is lower than that of the heating value per unit area of the paper-contact heating region heating layer 222*a*.

When a ratio of the heating value per unit area of the paper-contact heating region 220*a* and the heating value per unit area of the paper non-contact heating region 220*b* is 1:0.1 to 1:0.7, the paper non-contact heating region 220*b* is not overheated. A ratio of the specific resistance of the paper-contact heating region heating layer 222*a* and the specific resistance of the paper non-contact heating region heating layer 222*b* may be adjusted to, for example, from 1:0.1 to 1:0.7.

The heating layer 222 of the heating member 220 may be formed by dispersing carbon nanotube (CNT) in polyimide. The heating member 220 formed of a dispersion of carbon nanotube in polyimide directly transfers heat to the recording medium P, thus enabling rapid increase in temperature at a low consumption power and reduction of an initial printing time of the image forming apparatus 100.

Six carbon atoms are bonded to three carbon atoms to form a plurality of hexagons and the hexagons are connected to one another to form carbon nanotubes having a diameter of several nanometers (nm). The carbon nanotube has similar a thermal conductivity to diamond which has the highest thermal conductivity in the natural system and similar electric conductivity to copper.

Polyimide is a highly heat resistance plastic synthesized from aromatic diamine and aromatic tetracarboxylic dianhydride. Polyimide is generally used as a material for electric and electrical components due to superior heat resistance and insulating property.

Polyimide is a nonconductor which does not conduct electricity, but electric properties thereof are changed, when carbon nanotubes are dispersed in polyimide. That is, polyimide, in which carbon nanotubes are dispersed, transforms into a conductor which conducts electricity. Specific resistance of polyimide decreases, as carbon nanotube content increases.

The polyimide, in which carbon nanotubes are dispersed, may be obtained by the following process.

A polyimide precursor is produced. The polyimide precursor may be produced by polymerizing aromatic diamine with tetracarboxylic dianhydride in the presence of an organic polar solvent, followed by imidization. For example, 2,800 g of N-methyl pyrolidone (NMP) as an organic polar solvent is added under a nitrogen atmosphere into a stirrer, 341.73 g of '4-4'-diamino diphenyl ether (DPE) is added thereto, and stirring is performed until the DPE is completely dissolved. After DPE is completely dissolved, 361.99 g of pyromellitic dianhydride (PMDA) is added to the solution and stirred at a temperature of 0° C. at a rate of 120 to 150 rpm for 4 hours in the stirrer. As a result, a polyimide precursor having a weight ratio of polyimide of 20% and a viscosity of 1,700 poise is synthesized.

For example, 600 g of NMP and 51 g of a carbon fiber are mixed with 1,000 g of the synthesized polyimide precursor to produce a raw material for the paper-contact heating region heating layer 222*a*.

The raw material for the paper-contact heating region heating layer 222*a* is applied to an outer circumferential surface of a cylindrical mold having a diameter of 24 mm, dried and thermally treated at 380° C. to obtain polyimide containing carbon nanotubes dispersed therein, used for the paper-contact heating region heating layer 222*a*.

When 600 g of NMP and 130 g of a carbon fiber are mixed with 1,000 g of the polyimide precursor, the raw material for the paper non-contact heating region heating layer 222*b* is produced. When the raw material for the paper non-contact heating region heating layer 222*b* is applied to an outer circumferential surface of a cylindrical mold having a diameter of 24 mm, dried and thermally treated at 380° C., to obtain polyimide containing carbon nanotube dispersed therein, used for the paper non-contact heating region heating layer 222*b*.

As illustrated in FIG. 3, the paper-contact heating region heating layer 222*a* may be provided in the center of the heating member 220 and the paper non-contact heating region heating layer 222*b* may be provided at an edge of the heating member 220. So as to dispose the paper-contact heating region heating layer 222*a* and the paper non-contact heating region heating layer 222*b* in parallel, the raw material for the paper-contact heating region heating layer 222*a* may be applied to the center of the outer circumferential surface of the cylindrical mold and the raw material for the paper non-contact heating region heating layer 222*b* is applied at an edge of the mold, followed by drying and thermally treating at 380° C., to obtain the heating layer 222 divided into the paper-contact heating region heating layer 222*a* and the paper non-contact heating region heating layer 222*b*.

The paper-contact heating region heating layer 222*a* includes 51 g of a carbon fiber that is a conductor with respect to 1,000 g of the polyimide precursor, and the paper non-contact heating region heating layer 222*b* includes 130 g of a carbon fiber with respect to 1,000 g of the polyimide precursor, enabling the specific resistance of the paper-contact heating region heating layer 222*a* to be higher than the specific resistance of the paper non-contact heating region heating layer 222*b*. Thus, a heating value per unit area of the paper-contact heating region heating layer 222*a* is higher than the heating value per unit area of the paper non-contact heating region heating layer 222*b*.

The insulating layer 224 insulates the heating layer 222 from the outside. Polyimide which is the raw material for the heating layer 222 is a nonconductor, but polyimide is transformed into a conductor conducting electricity and electric properties thereof are changed, when carbon nanotubes are disposed therein. The heating layer 222 may be provided at the outside thereof with an insulating layer 224 in order to insulate the heating layer 222 which is a conductor from the outside.

The insulating layer 224 may be formed of a silicone rubber. A primer to stably adhere the heating layer 222 to the insulating layer 224 and a liquid silicone rubber are sequentially applied to the outer circumferential surface of the heating layer 222. The heating layer 222 may be cured to obtain an insulating layer 224 formed of a silicone rubber having elasticity. The silicone rubber may be a polydimethyl silicone rubber, a metal vinyl silicone rubber, a metal phenyl silicone rubber or a fluorosilicone rubber.

The insulating layer 224 may have a thickness of 50 to 300 um in order to secure sufficient insulating property and heat transfer from the heating layer 222 to the recording medium P.

The release layer 226 prevents foreign matter, for example, toner transferred to the recording medium P or toner floating in the image forming apparatus 100, from being adhered to the surface of the heating member 220.

The release layer 226 may be formed by sequentially applying a primer for stable adhesion to the insulating layer 224 and perfluoroalkoxy (PFA) to the outer circumferential surface of the insulating layer 224, followed by curing.

The release layer 226 may have a thickness of 5 to 50 um.

Figure 5:
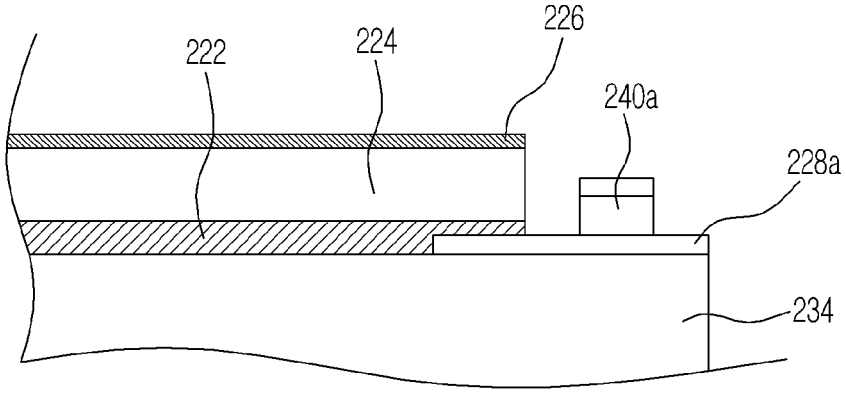
FIG. 5 is a sectional view along the line C-C' of FIG. 2.

FIG. 5 is a sectional view taken along the line C-C' of FIG. 2.

Referring to FIG. 5, the electrode 228*a* may be provided at both ends of the heating member 220. The electrode 228*a* may be formed on an outer surface of the elastic layer 234, has an exposed portion exposed to the outside, and directly contacts a heating layer 222 formed on an outer surface of a portion not exposed to the outside. The exposed portion of the electrode 228*a* may contact a brush 240*a* connected to the power supply (not shown), to provide a passage supplying a power to the heating layer 222.

The electrode 228*a* may be formed with the cylindrical mold, before the heating layer 222 is formed. The heating layer 222, the insulating layer 224 and the release layer 226 are then formed. A masking material may be applied to a part of the surface of the cylindrical mold, in which the electrode 228*b* is not formed, and a metal material for the electrode 228*b* may be applied thereon by plating or deposition. The deposition of the metal material may be carried out using an evaporation deposition process including heating a metal material to obtain a liquid metal and depositing a gas metal evaporated from the liquid metal on a cylindrical mold, or a sputtering process including colliding a metal material with accelerated electrons to separate metal atoms from the metal material and depositing the separated metal atoms on the cylindrical mold.

The masking material and the metal material deposited on the masking material may be removed, e.g., simultaneously removed to form the electrode 228*b* on both ends of the heating member 220.

Figure 6:
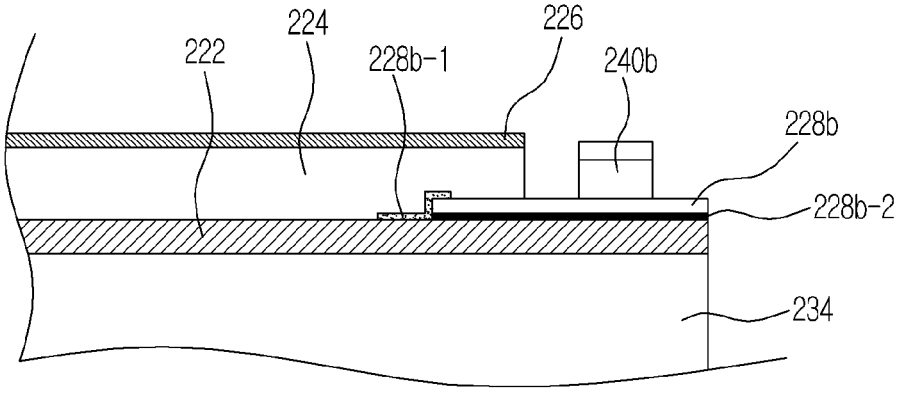
FIG. 6 illustrates an exemplary electrode of a fusing unit according to an embodiment of the present invention.

FIG. 6 illustrates an example of a configuration of an electrode included in the fusing unit 200 according to an embodiment of the present invention.

Referring to FIG. 6, the electrode 228*b* is provided on both ends of the heating member 220 and is formed on the heating layer 222. A portion of the electrode 228*b* may be exposed to the outside and the remaining portion thereof contacts the insulating layer 224 of the heating member 220. The exposed portion of the electrode 228*b* contacts a brush 240*b* connected to the power supply (not shown).

The electrode 228*b* may be fixed on the heating layer 222 through a non-conductive adhesive sheet 228*b*-2 and electricity passes between the electrode 228*b* and the heating layer 222 through a metal paste 228*b*-1. The electrode 228*b* may be formed by the following process. After the heating layer 222 is formed, the adhesive sheet 228*b*-2 may be applied to a region in which the electrode 228*b* is to be provided, the metal material for the electrode 228*b* is applied to the adhesive sheet 228*b*-2, and the metal paste 228*b*-1 is applied to parts of the electrode 228*b* and the heating layer 222.

Alternatively, before the formed heating layer 222 is sufficiently cured, a conductive material for the electrode 228*b* may be applied to the heating layer 222 and the heating layer 222 is cured, to adhere the electrode 228*b* to the heating layer 222. In this case, the metal paste 228*b*-1 and the adhesive sheet 228*b*-2 need not be formed.

Figure 7:
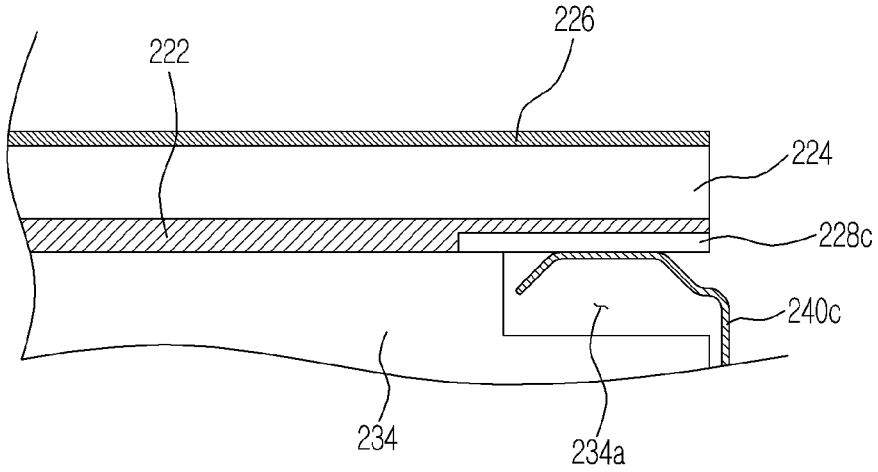
FIG. 7 illustrates an exemplary electrode of a fusing unit according to an embodiment of the present invention.

FIG. 7 illustrates an example of a configuration of an electrode included in the fusing unit 200 according to an embodiment of the present invention.

Referring to FIG. 7, the electrode 228*c* may be provided at both ends of the heating member 220 and formed outside of the elastic layer 234. The outside of the electrode 228*c* may be surrounded by the heating layer 222 and the electrode 228*c* is not exposed to the outside. In this case, a groove 234*a* may be provided in the elastic layer 234 provided inside the heating member 220 and contacts the brush 240*c* inside the electrode 228*c*.

The temperature sensor 250 senses a temperature of the heating member 220 while not contacting the heating member 220.

The temperature sensor 250 may include temperature sensors 250, e.g., three temperature sensors provided around the heating member 220, as illustrated in FIG. 2. The temperature sensors 250 may be provided in the center and both ends of the heating member 220 and sense temperatures the paper-contact heating region 220*a* and the paper non-contact heating region 220*b* of the heating member 220.

The temperature sensor 250 may use a thermistor and the temperature sensor 250 senses variation in electrical resistance of the thermistor according to temperature variation of the heating member 220 and thereby senses the temperature of the heating member 220.

The temperature of the heating member 220 sensed by the temperature sensor 250 may be supplied to a control unit. The control unit supplies power to the heating member 220 according to the sensing result of the temperature sensor 250.

FIG. illustrates an exemplary fusing unit 300 according to an embodiment of the present invention.

Figure 8:
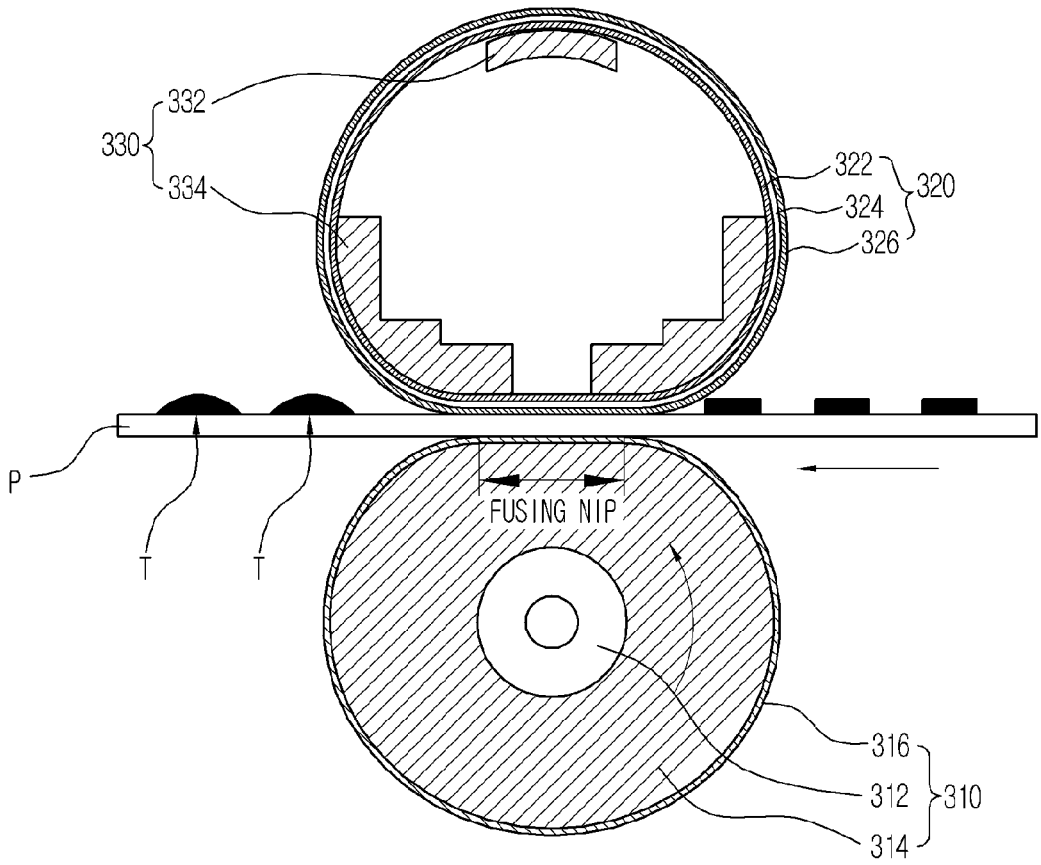
FIG. 8 illustrates a fusing unit according to an embodiment of the present invention.

Referring to FIG. 8, the fusing unit 300 according to an embodiment includes a pressurizing member 310, a heating member 320 and a support member 330.

The pressurizing member 310 may have a similar configuration and function as the pressurizing member 210 of the fusing unit 200 according to an embodiment of the present invention illustrated in FIG. 4. The pressurizing member 310 includes a core 312 to support the pressurizing member 310, an elastic layer 314 to elastic-restore the pressurizing member 310 to an original shape when the surface of the pressurizing member 310 is crushed, and a release layer 316 to prevent foreign matter such as toner from being adhered to the surface of the pressurizing member 310.

The support member 330 includes a fusing nip plate 334 that is provided in an area in which the support plate 332 to maintain the shape of the heating member 320, while the heating member 320 rotates, and the heating member 320 contact the pressurizing member 310 and receive pressure therefrom, to enable formation of a fusing nip between the heating member 320 and the pressurizing member 310. The support member 330 is provided inside of the fusing unit 300 and supports the heating member 320 so as to enable the heating member 320 to rotate.

The heating member 320 may have a cylindrical hollow shape and includes heating layer 322 to generate Joule heat, a insulating layer 324 to insulate the heating layer 322 from the outside, a release layer 326 to prevent foreign matter from being adhered to the surface of the heating member 320 and an electrode (not shown) to supply power to the heating layer 322. The heating member 320 receives power from the electrode (not shown) and generates heat to melt a toner image T transferred to the recording medium P.

The heating member 320 may be divided into a paper-contact heating region (not shown) contacting the recording medium P and a paper non-contact heating region (not shown) not contacting the recording medium P. The heating layer 322 includes a paper-contact heating region heating layer (not shown) corresponding to the paper-contact heating region (not shown) and a paper non-contact heating region heating layer (not shown) corresponding to the paper non-contact heating region, and a heating value per unit area of the paper-contact heating region heating layer (not shown) is different from that of the paper non-contact heating region heating layer (not shown).

The heating member 320 contacts the pressurizing member 310 via the fusing nip plate 334, and receives rotational force from the rotating pressurizing member 310 and thereby rotates along the outer surface of the support plate 332 and the fusing nip plate 334.

The heating member 320 may not be fixed on the support plate 332 and the fusing nip plate 334 and the support member 330 does not rotate, when the heating member 320 rotates while contacting the pressurizing member 310. That is, the heating member 320 may slidably rotate along the outer surface of the support member 330. As illustrated in FIG. 8, when the pressurizing member 310 rotates counterclockwise, the heating member 320, having a cylindrical shape, rotates clockwise and the support member 330 does not rotate by rotation of the pressurizing member 310.

Figure 9:
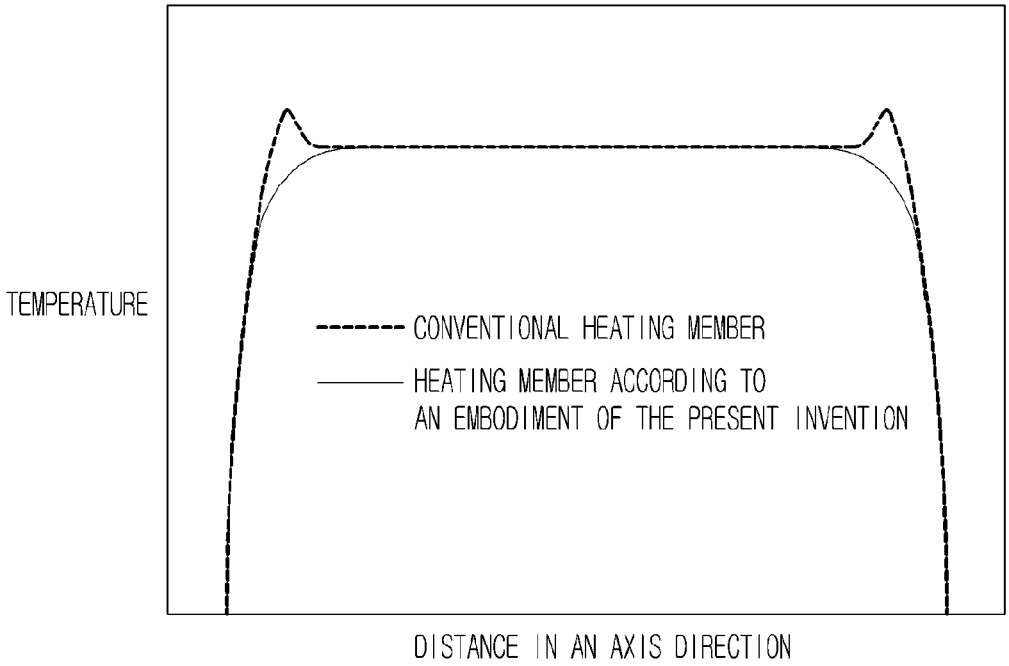
FIG. 9 illustrates an exemplary variation in temperature according to position with respect to a conventional heating member and a heating member according to an embodiment of the present invention.

FIG. 9 illustrates an exemplary variation in temperature according to position with respect to a conventional heating member and a heating member according to an embodiment of the present invention. In FIG. 9, a variation in temperature according to position according to the conventional heating member is represented by a dashed line, whereas a variation in temperature according to position with respect to the heating member 220 according to an embodiment of the present invention is represented by a solid line.

Referring to FIG. 9, a center of the conventional heating member transfers heat energy to the recording medium P and thereby maintains the temperature, whereas an edge of the heating member does not transfer heat energy to the recording medium P and is overheated due to accumulated heat energy.

On the other hand, the heating member 220 according to an embodiment of the present invention has different heating values per unit area of the paper-contact heating region and the paper non-contact heating region, thus offsetting great difference in temperature between the center and the edge thereof.

Figure 10:
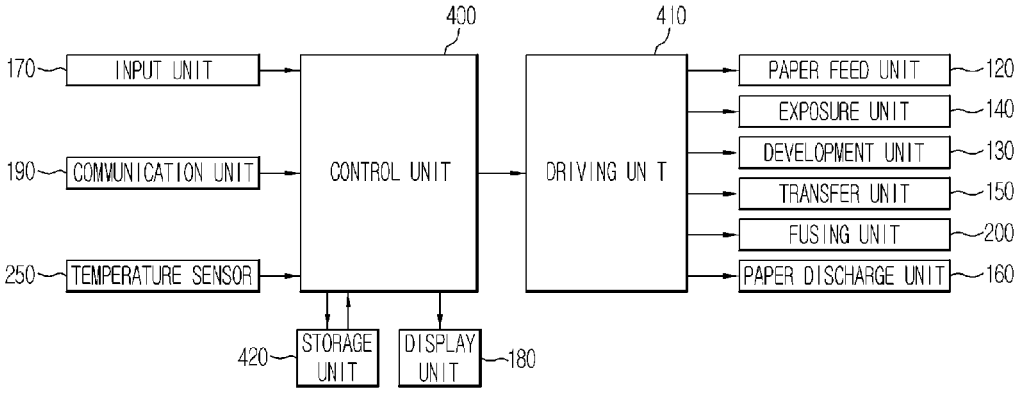
FIG. 10 illustrates an exemplary control flow of an image forming apparatus according to an embodiment of the present invention.

FIG. 10 illustrates an exemplary control flow of the image forming apparatus 100 according to an embodiment of the present invention.

The paper feed unit 120, the exposure unit 140, the development unit 130, the transfer unit 150, the fusing unit 200, and the paper discharge unit 160 are disclosed herein.

An input unit 170 may be provided in an upper part of the image forming apparatus 100 and receives user commands associated with operations of the image forming apparatus 100, e.g., on/off of the image forming apparatus 100, operation stop of the image forming apparatus 100 and selection of a communication port.

A display unit 180 may be provided in an upper part of the image forming apparatus 100 and displays information associated with operations of the image forming apparatus 100, e.g., on/off of the image forming apparatus 100, operation stop of the image forming apparatus 100 and selection of communication port.

The communication unit 190 may be provided at a rear surface of the image forming apparatus 100 and receives information of image formed by the image forming apparatus 100 from an external device (not shown).

A driving unit 410 includes a driving motor (not shown) to supply rotational force to the pressurizing member 210 of the fusing unit 200, and drives respective units of the image forming apparatus 100 according to control signal of the control unit 400 as described later.

A storage unit 420 stores image information supplied from the communication unit 190. The storage unit 420 to temporarily store image information to be printed may be used, since a velocity at which the image forming apparatus 100 performs printing on the recording medium is lower than that a velocity at which image information is supplied by the communication unit 190.

The control unit 400 controls the overall operation of the image forming apparatus 100 so as to form an image corresponding to image information supplied from the communication unit 190 on the recording medium P.

When the image forming apparatus 100 receives image information from the communication unit 190, the image forming apparatus 100 controls the driving unit 410 such that the paper feed unit 120 supplies a recording medium P, the exposure unit 140 irradiates light corresponding to the image information to the photosensitive material 131, the development unit 130 develops a toner image T corresponding to the image information, the transfer unit 150 transfers the toner image T developed on the photosensitive material 131 to the recording medium P, the fusing unit 200 fuses the toner image T transferred to the recording medium P on the recording medium P, and the paper discharge unit 160 discharges the toner image T-fused recording medium P.

An exemplary operation of the fusing unit 200 according to an embodiment of the present invention is disclosed.

The control unit 400 supplies power to the heating member 220 to heat the heating member 220, when the image forming apparatus 100 turns on, and the input unit 170 receives image information from the communication unit 190.

The heating member 220 may be heated at 180° C. or higher, so that the heating member 220 melts the toner. The control unit 400 determines whether the temperature of the heating member 220 reaches 180° C., based on sensing results of the temperature sensor 250. When the temperature reaches 180° C., the control unit 400 stops supplying power to the heating member 220 and drives the pick-up roller 122 to supply the recording medium P to the development unit 130 and the transfer unit 150 and thereby form a toner image T on the recording medium P.

In the process of forming the image, the heating member 220 continues supplying heat energy to the recording medium P, thus decreasing the temperature of the heating member 220. When the temperature of the heating member 220 decreases to 160° C. or less, as sensing results of the temperature sensor 250, the control unit 400 supplies power to the heating member 220 again to heat the heating member 220 and maintains the temperature of the heating member 220.

The power supply (not shown) receives an alternating current power from an exterior power source, converts the same into direct current power and supplies the direct current power to respective units of the image forming apparatus 100.

Exemplary embodiments of the present invention provide a fusing unit that prevents overheating of a paper-contact heating region without idling the fusing unit in order to radiate heat accumulated in the paper-contact heating region and an image forming apparatus including the same.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A fusing unit to fuse an image to a recording medium by applying heat and pressure to the recording medium, the fusing unit comprising:

a heating member to heat the recording medium; and a pressurizing member to apply pressure to the recording medium, wherein the heating member is divided into a paper-contact heating region contacting the recording medium and a paper non-contact heating region not contacting the recording medium, and a heating value per unit area of the paper-contact heating region is different from a heating value per unit area of the paper non-contact heating region, the heating member comprising a heating layer to generate heat to enable heating of the recording medium, the heating layer comprising polyimide containing carbon nanotubes (CNTs), and a mixture ratio between the polyimide and the CNTs in the paper-contact heating region and a mixture ratio between the polyimide and the CNTs in the paper non-contact heating region is different.

2. The fusing unit according to claim 1, wherein the heating value per unit area of the paper-contact heating region is greater than the heating value per unit area of the paper non-contact heating region.

3. The fusing unit according to claim 1, wherein a ratio of the heating value per unit area of the paper-contact heating region and the heating value per unit area of the paper non-contact heating region is 1:0.1 to 1:0.7.

4. The fusing unit according to claim 1, wherein the heating member further comprises an insulating layer provided on an outer surface of the heating layer to insulate the heating layer from the outside.

5. The fusing unit according to claim 4, wherein the heating member further comprises a release layer to form a surface of the heating member and prevent foreign matter from being adhered to the surface of the heating member.

6. The fusing unit according to claim 5, wherein the heating member further comprises:

a core provided in the center of the heating member to support the heating member, and an elastic layer to supply elasticity to the heating member so as to form a fusing nip between the pressurizing member and the heating member.

7. The fusing unit according to claim 6, wherein the pressurizing member comprises:

a core provided in the center of the pressurizing member to support the pressurizing member;

an elastic layer to elastic-restore the pressurizing member to an original shape when a surface of the pressurizing member is crushed; and a release layer to prevent foreign matter from being adhered to the surface of the pressurizing member.

8. The fusing unit according to claim 6, wherein the heating member further comprises an electrode to supply power to the heating member at both ends thereof.

9. The fusing unit according to claim 8, wherein the electrode is provided outside of the elastic layer of the heating member.

10. The fusing unit according to claim 9, wherein a portion of the electrode contacts the heating layer and the remaining portion thereof is exposed to the outside.

11. The fusing unit according to claim 9, wherein the electrode is formed on an outer surface of the elastic layer of the heating member by plating or deposition.

12. The fusing unit according to claim 8, wherein the electrode is provided outside of the heating layer.

13. The fusing unit according to claim 12, wherein the heating member further comprises:

an adhesive sheet to fix the electrode on the outer surface of the heating layer; and a metal paste to electrically connect the electrode to the heating layer.

14. The fusing unit according to claim 8, wherein the electrode is provided on an inner surface of the heating layer.

15. The fusing unit according to claim 14, wherein the elastic layer of the heating member comprises a groove to expose an inner surface of the electrode to the outside.

16. The fusing unit according to claim 5, further comprising a support member to support the heating member, wherein the heating member has a cylindrical hollow shape and contacts an outer surface of the support member.

17. The fusing unit according to claim 16, wherein the support member comprises:

a support plate to maintain a shape of the heating member; and a fusing nip plate to enable formation of a fusing nip between the heating member and the pressurizing member.

18. The fusing unit according to claim 17, wherein the heating member rotates along the outer surface of the support member, when it receives rotational force from the pressurizing member.

19. An image forming apparatus to form an image on a recording medium, comprising:

a fusing unit comprising a heating member to heat the recording medium and a pressurizing member to apply pressure to the recording medium, the fusing unit fusing the image to the recording medium by applying heat and pressure to the recording medium;

a driving unit to supply rotational force to the pressurizing member; and a power supply to supply power to the heating member and the driving unit, wherein the heating member is divided into a paper-contact heating region contacting the recording medium and a paper non-contact heating region not contacting the recording medium, and a heating value per unit area of the paper-contact heating region is different from a heating value per unit area of the paper non-contact heating region, and the heating member comprising a heating layer to generate heat to enable heating of the recording medium, the heating layer comprising polyimide containing carbon nanotubes (CNTs), and a mixture ratio between the polyimide and the CNTs in the paper-contact heating region and a mixture ratio between the polyimide and the CNTs in the paper non-contact heating region is different.

20. The image forming apparatus according to claim 19, wherein the heating value per unit area of the paper-contact heating region is greater than the heating value per unit area of the paper non-contact heating region.

21. The image forming apparatus according to claim 20, wherein a ratio of the heating value per unit area of the paper-contact heating region and the heating value per unit area of the paper non-contact heating region is 1:0.1 to 1:0.7.

22. The image forming apparatus according to claim 19, wherein the heating member further comprises an insulating layer provided on an outer surface of the heating layer to insulate the heating layer from the outside.

23. The image forming apparatus according to claim 22, wherein the heating member further comprises a release layer to form a surface of the heating member and prevent foreign matter from being adhered to the surface of the heating member.

24. The image forming apparatus according to claim 23, wherein the heating member further comprises:

a core provided in the center of the heating member to support the heating member; and an elastic layer to supply elasticity to the heating member so as to form a fusing nip between the pressurizing member and the heating member.

25. The image forming apparatus according to claim 24, wherein the pressurizing member comprises:

a core provided in the center of the pressurizing member to support the pressurizing member;

an elastic layer to elastic-restore the pressurizing member to an original shape when a surface of the pressurizing member is crushed; and a release layer to prevent foreign matter from being adhered to the surface of the pressurizing member.

26. The image forming apparatus according to claim 24, wherein the heating member further comprises an electrode to supply power to the heating member at both ends thereof.

27. The image forming apparatus according to claim 26, wherein the electrode is provided outside of the elastic layer of the heating member.

28. The image forming apparatus according to claim 27, wherein a portion of the electrode contacts the heating layer and the remaining portion thereof is exposed to the outside.

29. The image forming apparatus according to claim 27, wherein the electrode is formed on an outer surface of the elastic layer of the heating member by plating or deposition.

30. The image forming apparatus according to claim 26, wherein the electrode is provided outside of the heating layer.

31. The image forming apparatus according to claim 30, wherein the heating member further comprises:

an adhesive sheet to fix the electrode on the outer surface of the heating layer; and a metal paste to electrically connect the electrode to the heating layer.

32. The image forming apparatus according to claim 26, wherein the electrode is provided on an inner surface of the heating layer.

33. The image forming apparatus according to claim 32, wherein the elastic layer of the heating member comprises a groove to expose an inner surface of the electrode to the outside.

34. The image forming apparatus according to claim 23, further comprising a support member to support the heating member, wherein the heating member has a cylindrical hollow shape and contacts an outer surface of the support member.

35. The image forming apparatus according to claim 34, wherein the support member comprises:

a support plate to maintain a shape of the heating member; and a fusing nip plate to enable formation of a fusing nip between the heating member and the pressurizing member.

36. The image forming apparatus according to claim 35, wherein the heating member rotates along the outer surface of the support member, when it receives rotational force from the pressurizing member.

* * * * *